United States Patent [19]

Wegner et al.

[11] 4,132,019

[45] Jan. 2, 1979

[54] POWER OPERATED COPYHOLDER

[75] Inventors: John F. Wegner, Des Plaines; Walter Heyek, Chicago, both of Ill.

[73] Assignee: Edanbob Corporation, Franklin Park, Ill.

[21] Appl. No.: 718,955

[22] Filed: Aug. 30, 1976

[51] Int. Cl.[2] ..... B41J 11/38

[52] U.S. Cl. ..... 40/349

[58] Field of Search ..... 40/342, 349, 343, 65; 40/343, 52 R

[56] References Cited

U.S. PATENT DOCUMENTS

| | | | |
|---|---|---|---|
| 750,230 | 1/1904 | Shobert | 40/349 |
| 1,483,101 | 2/1924 | MacDowell | 40/343 |
| 2,179,419 | 11/1939 | Meek | 40/343 |
| 2,331,149 | 10/1943 | Van Buren | 40/349 X |
| 2,350,365 | 6/1944 | Miller | 40/349 |
| 2,791,047 | 5/1957 | Viskozki | 40/65 X |
| 3,449,849 | 6/1969 | Pasquale et al. | 40/343 |
| 3,882,620 | 5/1975 | Grindle | 40/343 |
| 3,983,651 | 10/1976 | Dickey | 40/343 |

*Primary Examiner*—Russell R. Kinsey
*Assistant Examiner*—Wenceslao J. Contreras
*Attorney, Agent, or Firm*—Emrich, Root, O'Keefe & Lee

[57] ABSTRACT

A power operated copyholder is disclosed wherein a face plate, on which one or more copy sheets containing matter to be copied by a typist is mounted, moves upwardly one or more lines at a time while being viewed and copied by the typist. An adjustable line guide remains stationery with respect to the copy matter, and movement of the face plate is controlled by the typist either by hand or by a foot pedal. Spring activated paper holders are provided which are adjustable to suit the width of the copy matter being copied. Tension on the line guide may also be adjusted for the amount of paper being used and is adjustable also for a proper light angle. A novel form of adjustment is also provided for the purpose of adjusting the angle of the face plate with respect to a vertical plane, for the comfort of the typist.

8 Claims, 11 Drawing Figures

5,6
5,6

UP
DN

OVER - SIZE
HOLE
PIN
UP
DN

POWER OPERATED COPYHOLDER

BACKGROUND OF THE INVENTION

Copyholders have been provided heretofore wherein a sheet containing matter to be copied is supported on a surface to be viewed by a typist who is doing the copying. Line guides for covering the lines below (or above) the one being copied have also been provided. With the advent of larger sheets of copy material, such as computer printouts, etc. it has become necessary to enlarge the area which supports the copy sheets, as well as the line guide members which results in greater inconvenience to the typist in moving the line guide downwardly after each line has been copied.

Furthermore, the larger the copy support, the more cumbersome is the entire unit to handle and operate. Problems arise from the standpoint of efficient means to hold the copy sheet on the supporting surface; means to allow tilting of the supporting surface for the best light and comfortable reading angle; efficient control of the line guide; facilitating use of the apparatus for the efficiency and comfort of the typist and the like. These problems have been overcome in the present invention by power operation of the unit, together with additional improvements incident thereto.

BRIEF SUMMARY OF THE INVENTION

This invention relates to a power operated copyholder for use by a typist in copying, on typewriters or the like, material contained on a sheet of copy suitably supported for viewing by the typist, and is directed particularly to features which contribute to the comfort and efficiency of the typist, and which improve the operation of such a copyholder.

A support for the material to be copied is mounted on a frame for upward and downward movement with respect thereto. Movement of the copy support is power operated, such as by means of an electric motor controlled by the typist, and a line guide mounted on the stationary frame enables the typist to view the line being copied, and because this copy, rather than the guide moves from line to line, the typist is always viewing the line being copied at the same level.

In view of the foregoing it is a principle object of the present invention to provide a power operated copyholder wherein copy is moved with respect to a stationary line guide, and such movement is controlled by the typist.

Another object is to provide, in a power operated copyholder, novel means for securing a copy sheet in place on the support therefor.

A further object of the invention is to provide a novel line guide member for a power operated copyholder which is adjustably secured to the apparatus for adjustment by the typist for maximum comfort and convenience.

Yet another and more specific object of the invention, is to provide in a power operated copyholder, power means which includes an electric motor having a shaft thereon which is operatively connected to the moving copy support for upward and downward movement thereof, and wherein such movement is automatically stopped at the upper and lower extreme limits thereof.

Other objects and purposes of the invention will appear more fully as the description proceeds, having particular reference to the drawings.

DETAILED DESCRIPTION OF THE INVENTION

Figures 1, 1A, 2:
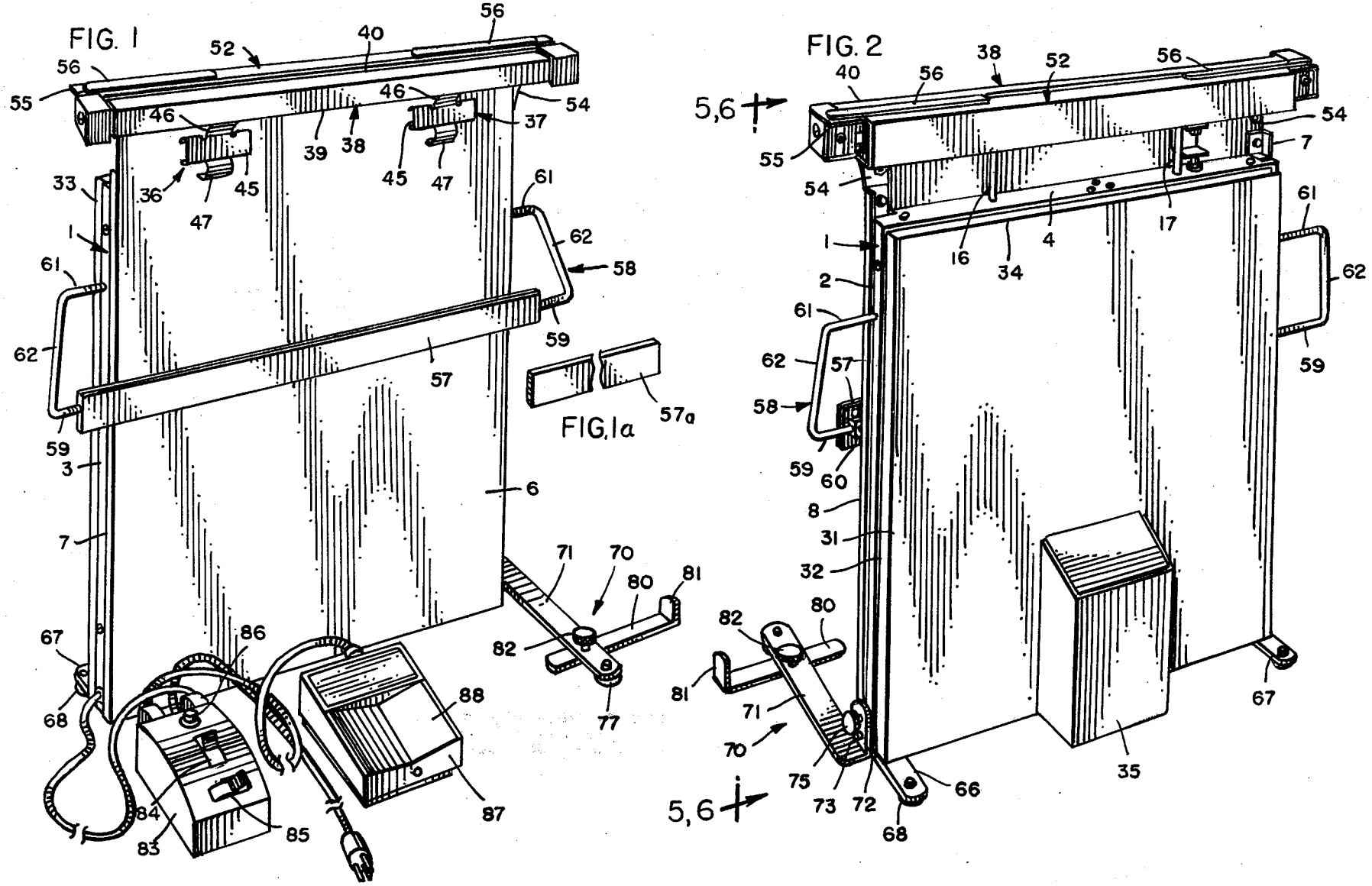
FIG. 1 is a perspective view of a power operated copyholder embodying the present invention as viewed from the front thereof and with the face plate for supporting the copy shown in the lower position thereof.
FIG. 1*a* is a fragmentary perspective view of a modified form of a line guide member.
FIG. 2 is a perspective view of the power operated copyholder as shown in FIG. 1, but viewing the apparatus from the rear thereof.

Referring now more particularly to the drawings and especially to FIGS. 1 through 5, there is provided a frame member generally indicated by the numeral 1 and which is comprised of the two vertical side members 2 and 3, and the upper and lower connecting members 4 and 5, connected to the vertical side members, thereby forming an open frame member.

A face plate 6 is movably supported with respect to the frame member and is adapted to support the copy matter which is to be copied by the typist. This face plate 6 is provided with the rearwardly extending side flanges 7 and 8, which slightly overlap the vertical side members 2 and 3 of the frame 1. It will be evident that, as far as the present invention is concerned, the face plate for supporting the copy matter may be any suitable size, but since the invention is particularly useful with respect to large sheets, such as computer printouts and the like, the device is designed to accomodate sheets up to 20 inches in width and has a travel of a full 14 inches upwardly permitting copying from legal documents and the like.

Figures 3, 4, 5:
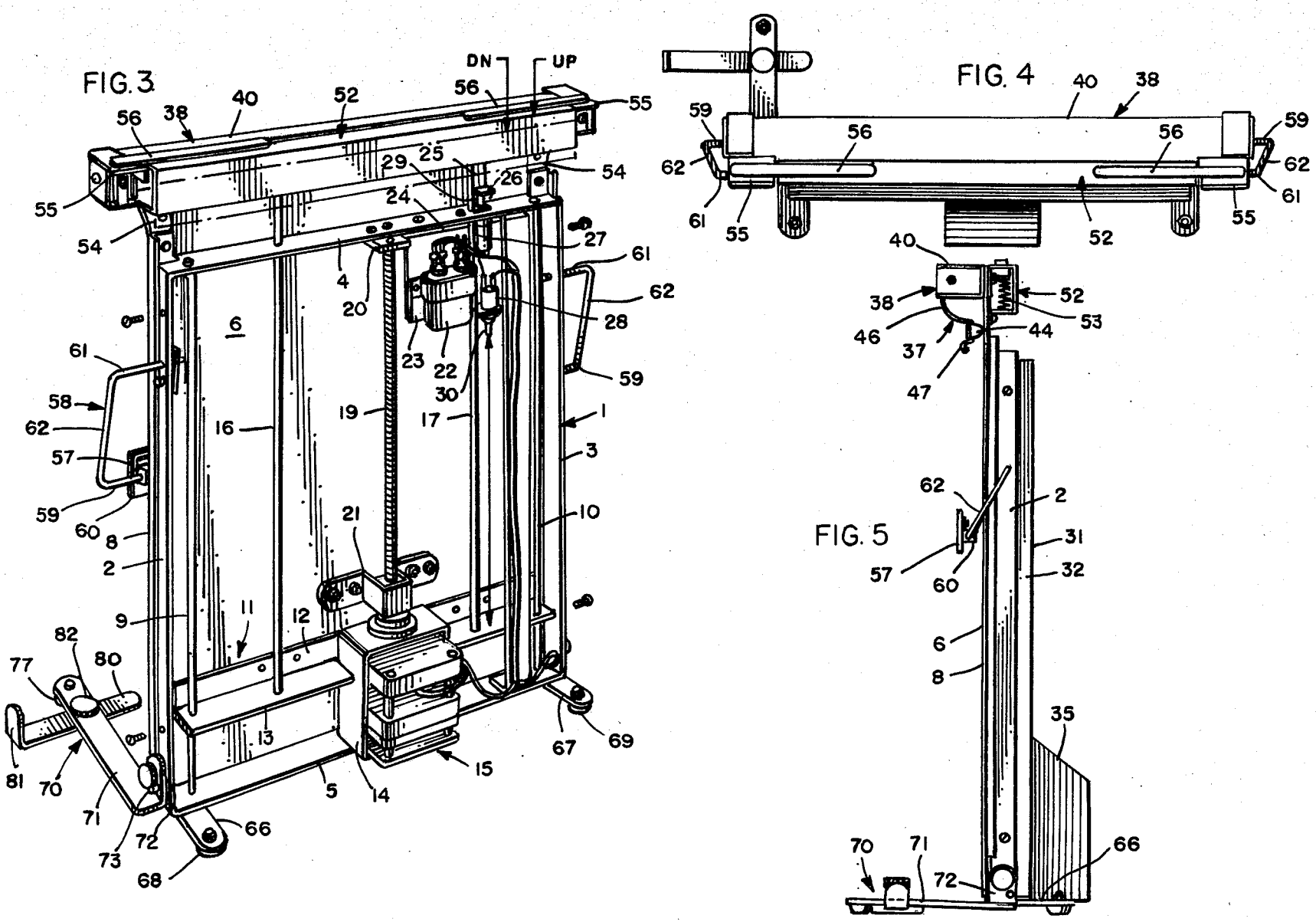
FIG. 3 is a view similar to FIG. 2, but with the rear cover plate thereof removed to illustrate details of the means for raising and lowering the face plate.
FIG. 4 is a top plan view of the copyholder shown in FIG. 3.
FIG. 5 is a side elevational view of the copyholder looking in the direction of the arrows 5—5 in FIG. 2.

A pair of guide rods 9 and 10 are located, one at each side of the apparatus as shown in FIG. 3, for the purpose of guiding the upward and downward movement of the face plate 6. Each guide rod is secured at its upper end to the top cross member 4 of the frame and at its lower end to the bottom cross member 5 of the frame member.

An angle member 11 is mounted on the rear side of the face plate 6 and extends transversely thereof. The vertical flange 12 of the angle member is secured to the face plate by suitable means, and the horizontal flange 13 thereof has a cut-out portion to receive the rectangular bracket 14, which houses the driving motor generally indicated by the numeral 15. A pair of rods 16 and 17 are mounted at their lower ends on the horizontal flange 13 of the angle member 11, and at their upper ends on a rearwardly extending flange member 18 (see FIG. 6). These rods 16 and 17 also pass through the upper cross member 4 of the frame member, so that, the rods 9, 10, 16 and 17 all provide guiding means for the upwardly and downwardly reciprocating movement of the face plate.

The upward and downward movement of the face plate is driven by the reversible motor 15 which is provided with suitable connections to the face plate so that when the motor is driven in one direction it will advance the face plate upwardly, and driven in the opposite direction it will move the face plate downwardly. Any suitable means between the motor and the face plate may be used for this purpose, but in the present invention there is illustrated herein an elongated vertically extending threaded rod 19, the lower end of which is mounted for rotation by the shaft of motor 15, and the upper end of which is mounted for rotation in the rearwardly extending plate 20 mounted on the upper cross member 4 of the main frame.

A bracket 21 is secured to the rear surface of the face plate 6 as shown more clearly in FIG. 3, and threadedly engages the rod 19. Thus, when the motor 15 is driven in one direction to rotate the threaded rod 19, its engagement with the bracket 21 mounted on the face plate will cause the bracket and face plate to move upwardly from the position thereof shown in FIG. 3. From an upper position of the face plate, driving the motor 15 in the opposite direction to rotate the rod 19, the bracket 21 and the face plate on which it is mounted will be moved downwardly.

A capacitor 22 is mounted on a bracket 23, which is, in turn, supported by the upper cross member 4 of the frame, by means of the horizontal flange 24 on the plate 23. This capacitor is connected to the motor 15 for the purpose of providing the advantage of starting the motor immediately at its full rate of speed. Normally, the motor would take a short time to reach its peak speed, but the capacitor eliminates this problem by immediately starting the motor at its full speed.

An angle member 25 having a horizontal flange portion 26 is mounted on the rear of the face plate 6 at the upper portion thereof as seen in FIG. 3. There is also provided two limit switches 27 and 28 mounted on the plate 23, and connected to the motor through the capacitor 22. When the face plate reaches its lowermost position, the horizontal flange 26 will come against the switch actuator 29 of the upper limit switch 27, thereby stopping the flow of current to the capacitor and immediately stopping the motor. When the face plate moves upwardly, the horizontal flange 13 will come against the switch actuator 30 of the lower limit switch 28 thereby to stop the flow of current to the capacitor and immediately stop operation of the motor. Thus, there is no need for concern in overrunning the face plate in either direction, because when its upper and lower limits are reached, movement thereof will stop automatically.

All of the foregoing elements which operate the device are then enclosed within a rear closure member 31 which is provided with the forwardly extending side flanges 32 (FIG. 2) and 33 (FIG. 1). These side flanges fit within the vertical side members 2 and 3 of the frame member and are removably secured thereto. The rear closure member also has a forwardly extending flange member 34 which, when the member is in place, abuts against the upper cross member 4. As may be seen in the various figures, the rear closure member 31 is also provided with a housing 35 which encloses the motor 15.

Figures 6, 7, 8, 9, 10:
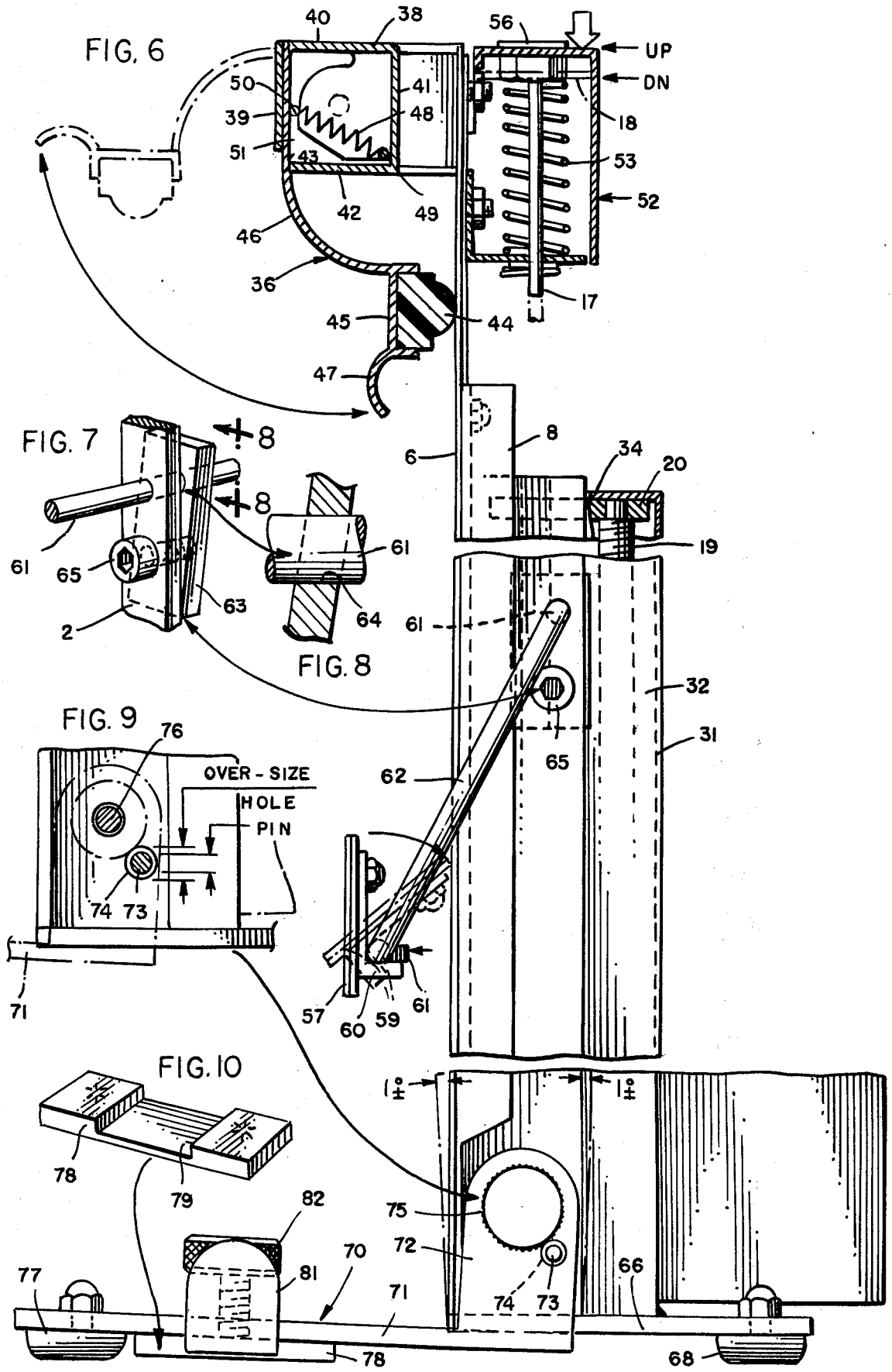
FIG. 6 is a fragmentary enlarged side elevational view, with parts shown in section for the sake of clarity, and looking in the direction of the arrows 6—6 of FIG. 2.
FIG. 7 is a fragmentary enlarged perspective view of a detail of the apparatus.
FIG. 8 is a fragmentary enlarged sectional view of a detail shown in FIG. 7 and which is taken along the plane of line 8—8 of FIG. 7.
FIG. 9 is a fragmentary enlarged elevational view of a detail shown in FIG. 6.
FIG. 10 is a perspective view of a detail of the adjustable support for the frame of the copyholder.

An important feature of the invention relates to the novel paper holders which hold the copy matter in position on the movable face plate. These paper holders may be seen in FIG. 1 and are identified by the numerals 36 and 37. These paper holders are mounted for sliding movement transversely of the face plate 6 in a housing 38 as seen in FIG. 1, and the sectional view therethrough as seen in FIG. 6. It will be noted that this housing 38 is substantially rectangular in shape and is provided with the front side 39, the top 40, the rear side 41, and the bottom 42. There is a space 43 between the lower edge of the front 49 and the forward edge of the bottom 42 within which the two paper holders 36 and 37 are secured.

Each paper holder includes one or more rearwardly extending friction members 44, such as rubber or a suitable plastic, which, pressed against a paper or other material having copy matter thereon, will securely hold it in place. These friction members are held within a channel member 45, and each such channel member is provided with a forwardly and upwardly extending tail piece which, as may be clearly seen in FIG. 6, extends upwardly through the opening 43 and is wedged securely therein so that it may slide longitudinally of the housing 38 and frictionally held in any position along the length thereof to which it may be adjusted. The lower part of each of the paper holders has an arcuately formed downwardly extending finger piece 47, which may be used by the typist to move the paper holders out of their paper holding position, thereby to enable fresh copy to be applied to the face plate.

The housing 38 is mounted for rotation about its longitudinal axis and may be rotated about this axis substantially 90°. A coiled tension spring 48 at each end of the housing has one end thereof secured to a rigid part of the face plate as at 49, and has its other end secured to a pin 50 on the end plate member 51 which is rotatable with the housing. The springs 48 are so positioned that they yieldably hold the friction members 44 against the copy paper as shown in full lines in FIG. 6. When it is desired to remove or replace copy paper, the paper holders may be rotated upwardly out of the way to the position shown by the dot-dash lines in FIG. 6. In moving from one position to the other the spring 48 will be moved past dead center and hold the friction members in either one of the two extreme positions. The pin 50 at each end of the housing may move against a suitable stop member to limit the upward movement thereof. In the dot-dash line position of the paper holders a new copy sheet may be placed on the face plate and, when it is adjusted to the proper position for the typist, the paper holders may be returned to the full line position shown in FIG. 6 for use.

Another feature of the invention is the provision of specially designed pressure means to facilitate the holding of fan-folded material. Such material would be longer than the height of the face plate and, therefore, a portion of it may extend beyond the upper edge of the face plate. The housing 38 is mounted in spaced relation to the face plate as may be noted in FIG. 6, so that fan-folded paper may extend upwardly between the housing 38 and the face plate. The pressure frame is indicated by the numeral 52 and is a hollow substantially rectangular housing as may be seen in FIG. 6. The rods 16 and 17 extend upwardly through this housing or pressure frame and each is surrounded by a coiled compression spring 53. Thus, this pressure frame may be moved downwardly manually against the pressure of the springs, which will return them their uppermost position in shown in FIG. 6.

A bracket 54 is mounted at each side of the face plate (FIG. 2) each of which has formed as a part thereof a horizontally extending flange 55. Each flange 55 has secured thereto a holding bar 56, which extend inwardly toward each other as may be seen in the various views. The spring members 53 urge the pressure frame 52 upwardly against these holding bars 56. When copy paper is of such length that it is desired to extend it upwardly beyond the top of the face plate, the pressure frame may be depressed away from the holding bars 56 so that the paper may be received within the space between these bars and the pressure frame. After the paper is properly located, manual pressure on the pressure frame 52 is released and the paper will be firmly held between this housing and the holding bars 56.

Further novel features are provided in the line guide member which the typist uses to indicate to her the line being copied. The line guide member of the present invention is indicated by the numeral 57 and is adjustably mounted on the vertical side members 2 and 3 of the frame member 1. An elongated rod generally indicated by the numeral 58 has a portion 59 thereof which extends along the rear side of the line guide 57. Each end of the line guide at the rear side thereof there is provided a mounting bracket 60 which receives the portion 59 of the rod 58. This detail may be seen more clearly in the enlarged view of FIG. 6. Each bracket 60 is provided with a screw 61 which frictionally holds the line guide 57 onto the rod 59 that may permit rotation of the line guide with respect to the rod.

Each end of the rod 58 is bent to provide a substantially U-shaped end portion consisting of a leg 61 and the connecting portion 62, wherein the other leg of the U-shaped member may be considered to be the portion 59 of the rod to which the line guide is secured. It will be evident that the portion 59 of the rod may extend the full length of the line guide, or it may be terminated adjacent the brackets 60.

Each leg 61 of the rod 58 is received within the vertical side members 2 and 3 of the frame member 1, and it will be evident that the line guide 57 is in its lowermost position as shown in FIGS. 1 and 2, but may be rotated about the legs 61 of the U-shaped end of the rod to an uppermost position, or to any intermediate position therebetween.

It will be evident from the foregoing description that the line guide member 57 may be rotated about the rod 59 and, in addition thereto the ability to rotate the entirely assembly upwardly and downwardly enables the line guide to assume a wide variety of positions suitable for the comfort and efficiency of the typist.

FIG. 1*a* illustrates a modified form of the line guide which is identified by the numeral 57*a*. This merely illustrates the fact that, instead of having a line guide which is opaque, it may be made of a transparent material, with a portion thereof along one of the longitudinal edges having a color different from the remainder of the transparent line guide to emphasize the line of the copy material which is being copied. For example, the main portion of the line guide 57*a* could be a clear transparent material, with a yellow line along one edge thereof as illustrated, so that this colored portion can be placed over the line being copied.

Referring now particularly to FIGS. 3, 6 and 7, there is illustrated a still further feature of the invention which involves the means by which the frictional tension on the line guide 57 and its supporting rod structure may be adjusted. As indicated above, the end portions of the supporting rod for the line guide indicated at 61 are received within suitable openings in the upright side members 2 and 3 of the main frame. One of these ends 61 of the rod is received within a suitable opening in a wedge plate 63. The opening 64 in this plate 63 is disposed angularly with respect to the surface of the plate as shown in FIG. 8, so that, when it receives the rod portion 61 the plate 63 will hang downwardly therefrom at an angle with the lower end thereof in contact with the inner surface of the vertical side member 2. Below the opening 64 there is provided a threaded hole which is adapted to receive the headed screw 65. The threaded shank of this screw passes through an elongated opening in the vertical side member 2 and is then threaded into the opening in the plate 63. The elongated opening is necessary to allow the screw to be slanted somewhat and received in the threaded opening of the plate. Obviously tightening of the screw 65 will draw the plate 63 in an angular direction toward the vertical side member and in a wedging action with respect to the sides of the hole 64, thereby wedging against the portion 61 of the rod creating greater friction so that the line guide may be held in any position to which it may be adjusted.

The entire device is designed so that it will be self standing in a substantially vertical position, and to assist in this function there is provided at each side of the main frame member the rearwardly extending feet 66 and 67. These feet are provided at the underside thereof with suitable rubber or other friction members 68 and 69.

A removable support member 70 is removably attached to the frame member and extends forwardly thereof to aid in the support. This removable support member includes a forwardly extending foot 71 having an upwardly extending flange member 72 thereon adapted to be secured to the side of the vertical side number 2.

This flange member 72 is provided with a pin 73 which extends therethrough and into an oversized hole 74 in the side member 2. An adjustment screw having a knurled head 75 is provided which threadedly engages an opening in the side member 2 and when this screw is loosened, the support member 70 may be pivoted slightly about the shank of the screw through as great an angle as may be permitted by the size of the oversized hole 74 through which the pin 73 extends.

In actual practice the hole 74 is sized so that the upright frame and face plate may be tilted forwardly or rearwardly a matter of about one degree, for the convenience and comfort of the typist.

The forward end of the foot 71 is provided on the lower side thereof with another rubber friction member 77. A guide and clamping member 78 (see FIG. 10) having a transversely extending recess 79 therein is mounted on the underside of the foot 71, and is adapted to receive therein the associated supporting foot 80 which has an outwardly upstanding end of portion 81 and is adapted for sliding movement lengthwise thereof between the underside of the foot 71 and the bottom of the recess 79. An adjustment screw 82 is threadedly received through an opening in the foot 71, the end of the shank of which is adapted to bear against the upper surface of the foot 80, thereby to secure the foot 80 into any position to which it may be adjusted.

It will be evident, therefore, that from the foregoing description the entire apparatus is peculiarly adapted for being self-supported either adjacent a typwriter at one side thereof or directly behind a typewriter where it may be viewed comfortably by the typist.

As mentioned heretofore, control means have been provided under the control of the typist for controlling the movement of the face plate with the copy matter thereon. FIG. 1 illustrates two forms of the control means for the typist. The numeral 83 identifies a manually operated control box having two switches thereon identified at 84 and 85. In actual practice, switch 84 may be manually pressed into either one of two positions, thereby to drive the face plate upwardly to downwardly. The switch member 84 is adapted to drive the face plate constantly in either direction. The switch 85, on the other hand, may be utilized to drive the face plate upwardly or downwardly a relatively short distance, for example, the distance of one line on the copy matter. In other words, depressing either side of the switch 85 will drive the face plate, but when the switch is released the driving motor ceases to function. This is distinguished from the switch 84 wherein depressing the switch and then releasing it allows the motor to run continuously.

The numeral 86 is an indicator light which remains on to show that the apparatus is connected to the electrical circuit.

The numeral 87 illustrates a pedal operated control box having a switch 88 thereon adapated to be suitably connected into the circuit to the driving motor. This control box may be located on the floor in a suitable position for operation by the foot of the typist. Depressing the switch 88 in one direction will drive the face plate upwardly, and in the other direction will drive the face plate downwardly.

From the foregoing description it will become evident that we have designed a power driven copyholder for typists which will enable them to copy from very large sheets, and which embodies a variety of novel features all as described hereinabove and which have numerous advantages over similar copyholders heretofore known.

Changes may be made in the form, construction and arrangement of parts from those disclosed herein without in any way departing from the spirit of the invention or sacrificing any of the attendant advantages thereof, provided, however, that such changes fall within the scope of the claims appended hereto.

We claim:

1. A power operated copyholder comprising (a) a frame member, (b) support means for supporting said frame member in a generally upright position, (c) a face plate slidably mounted on said frame member and adapted to have copy matter supported thereon for viewing and copying by a typist, (d) means for securing the copy matter on said face plate, including (1) a pair of spring activated paper holders movable between a copyrelease position and a copy-hold position, and (2) means mounting said paper holders for movement transversely of said face plate for adjustment to the width of the copy matter, (e) power means adapted to be controlled by a typist for raising and lowering said face plate with the copy matter thereon, and (f) a line guide member mounted on said frame member and extending transversely of said face plate, whereby said line guide member remains stationary while the copy matter is moved with respect thereto.

2. A power operated copyholder comprising (a) a frame member, (b) support means for supporting said frame member in a generally upright position, (c) a face plate slidably mounted on said frame member and adapted to have copy matter supported thereon for viewing and copying by a typist, (d) means for securing the copy matter on said face plate, including (1) an elongated support member extending transversely of said face plate and pivotally mounted thereon for rotation about its longitudinal axis, and (2) a pair of paper holders mounted on said support member adapted to hold copy matter on said face plate when said support is in one rotated position thereof, and to release the copy matter when said support member is in a different rotated position thereof, (e) power means adapted to be controlled by a typist for raising and lowering said face plate with the copy matter thereon, and (f) a line guide member mounted on said frame member and extending transversely of said face plate, whereby said line guide member remains stationary while the copy matter is moved with respect thereto.

3. A power operated copyholder as defined in claim 2, wherein said paper holders are slidably mounted on said elongated support member, whereby said paper holders may be moved transversely of said face plate for adjustment to the width of the copy matter.

4. A power operated copyholder comprising (a) a frame member, (b) support means for supporting said frame member in a generally upright position, (c) a face plate slidably mounted on said frame member and adapted to have copy matter supported thereon for viewing and copying by a typist, (d) means for securing the copy matter on said face plate, (e) power means adapted to be controlled by a typist for raising and lowering said face plate with the copy matter thereon, (f) a line guide member mounted on said frame member extending transversely of said face plate, whereby said line guide member remains stationary while the copy matter is moved with respect thereto, (g) pivot means for mounting said line guide member for movement between upper and lower positions to enable adjustment thereof with respect to the eye level of a typist, and (h) means for adjusting the tension on said pivot means.

5. A power operated copyholder as defined in claim 4, wherein said pivot means includes a rod having a substantially U-shaped portion at each end thereof, one leg of which extends longitudinally of said line guide member and on which said member is mounted, a flange at each side of said frame member, and the other leg of said rod being received within an opening in each of said flanges.

6. A power operated copyholder as defined in claim 5, wherein said means for adjusting tension on said pivot means includes a plate having an opening therethrough, the axis of which extends at an acute angle with respect to the face of said plate and receiving said other leg of one of said U-shaped portions therethrough, whereby one end of said plate will bear against the adjacent flange, a threaded opening in said plate adjacent the end thereof which bears against said adjacent flange, an elongated opening in said adjacent flange, and a screw extending through said elongated opening and threadedly engaging said threaded opening, whereby tightening said screw will cause a wedging action between said plate and said rod.

7. A power operated copyholder comprising (a) a frame member, (b) support means for supporting said frame member in a generally upright position, (c) a face plate slidably mounted on said frame member and adapted to have copy matter supported thereon for viewing and copying by a typist, (d) means for securing the copy matter on said face plate, (e) power means adapted to be controlled by a typist for raising and lowering said face plate with the copy matter thereon, (f) a line guide member mounted on said frame member and extending transversely of said face plate, whereby said line guide member remains stationary while the copy matter is moved with respect thereto, and (g) said line guide member being transparent and provided adjacent one edge thereof with a line having a different color than that of the remainder thereof and of sufficient width to substantially cover the line of copy being typed, thereby to emphasize to the typist the line being copied.

8. A power operated copyholder comprising (a) a frame member (b) support means for supporting said frame member in a generally upright position, (c) a face plate slidably mounted on said frame member and adapted to have copy matter supported thereon for viewing and copying by a typist, (d) means for securing the copy matter on said face plate, (e) power means adapted to be controlled by a typist for raising and lowering said face plate with the copy matter thereon, including (1) a reversible motor and shaft, (2) an elongated threaded rod extending in a generally vertical direction and parallel with the plane of said face plate and connected at one end thereof to said motor shaft, (3) means rotatably mounting the other end of said rod on said frame, (4) bracket means on said face plate threadedly engaging said rod, whereby rotation of said rod will move said bracket means and said face plate upwardly or downwardly, and (5) switch means for controlling the operation of said motor to drive said face plate in either direction, and (f) a line guide member mounted on said frame member and extending transversely of said face plate, whereby said line guide member remains stationary while the copy matter is moved with respect thereto.

* * * * *